United States Patent [19]

Ottemann

[11] Patent Number: 4,924,795

[45] Date of Patent: May 15, 1990

[54] WINCH FOR ROLLER REEFING

[75] Inventor: William C. Ottemann, Fremont, Calif.

[73] Assignee: International Marine Industries, Guilford, Conn.

[21] Appl. No.: 273,460

[22] Filed: Nov. 18, 1988

[51] Int. Cl.[5] ..... B63H 9/10

[52] U.S. Cl. ..... 114/107; 114/106

[58] Field of Search ..... 114/102–107

[56] References Cited

U.S. PATENT DOCUMENTS

| | | | |
|---|---|---|---|
| 4,248,281 | 2/1981 | Hood | 114/106 |
| 4,269,134 | 5/1981 | Shapland | 114/107 |
| 4,557,213 | 12/1985 | Maier | 114/106 |
| 4,573,424 | 4/1986 | Clausin | 114/106 |
| 4,723,499 | 2/1988 | Furgang | 114/106 |

FOREIGN PATENT DOCUMENTS

| | | | |
|---|---|---|---|
| 2431456 | 1/1976 | Fed. Rep. of Germany | 114/106 |

*Primary Examiner*—Joseph F. Peters, Jr.

*Assistant Examiner*—Clifford T. Bartz

*Attorney, Agent, or Firm*—Townsend and Townsend

[57] ABSTRACT

In a sailboat having a sail such as a Genoa jib with roller reefing for spirally winding the sail on a fairing around a stay, a winch mechanism for turning the fairing about the stay and spirally winding the sail to and from the fairing is disclosed. The winch includes a high mechanical advantage clutch, preferably a cone clutch, normally engaged by load between the sail and sheet exerting an unwinding force upon the fairing through the normally engaged clutch to a normally stationary clutch driving shaft. The clutch driving shaft has a first clutch member ratchetted from the vessel to permit turning of the entire clutch for taking in of the sail. The clutch includes a second clutch member attached for rotation with the fairing relative to the vessel and driven for both sail take-up and let out by the normally stationary clutch driving shaft. The normally stationary clutch driving shaft is in turn driven usually by a hydraulic motor or upon motor failure by a ratchetted winch handle.

6 Claims, 4 Drawing Sheets

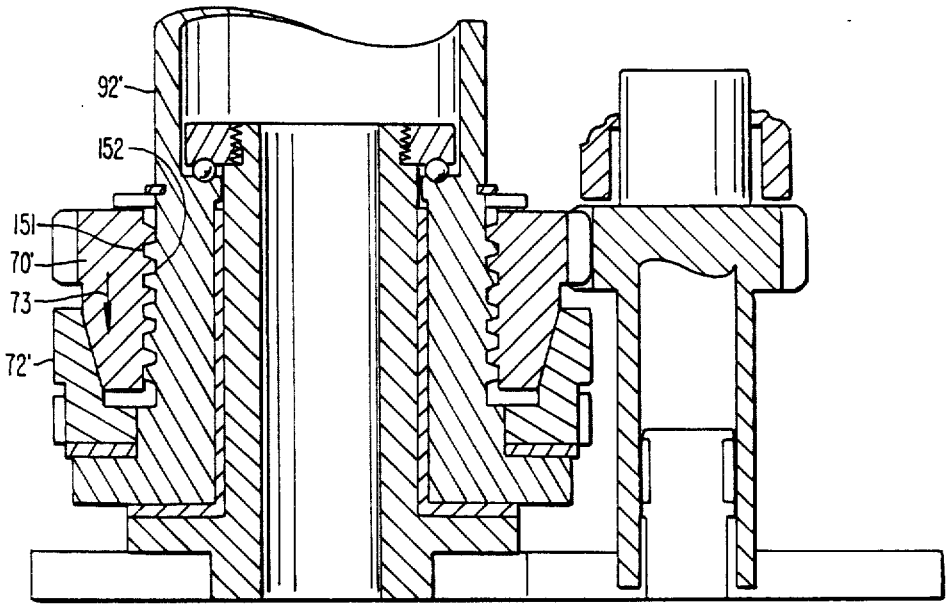
FIG._3.
FIG._2E.
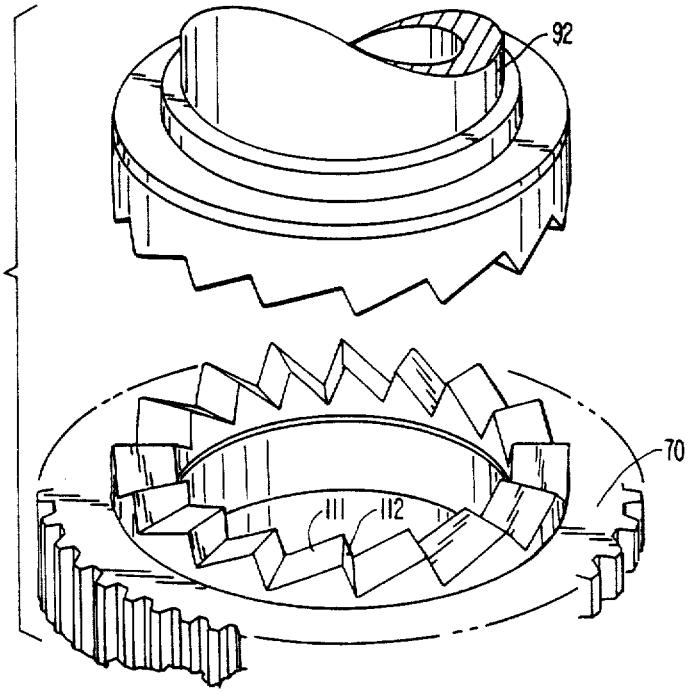

WINCH FOR ROLLER REEFING

This invention relates to roller reefing on sailboats. More particularly, a winch for imparting concentric rotation to a fairing rotatable about a stay on a sailing vessel is disclosed for spirally winding in and spirally letting out a jib.

SUMMARY OF THE PRIOR ART

Sails, especially cut, are used for roller reefing in substitution for large Genoa jibs on Marconi rigged sailboats. Such roller reefing sails are attached for rotation usually about the forestay of the vessel. The forestay has a hollow fairing that rotates around the stay. Typically, the luff of a specially cut Genoa jib is threaded to the fairing.

In operation, a winch mechanism causes rotation of the fairing around the stay. This rotation of the fairing around the stay winds the Genoa jib in a spiral wind to and from the stay.

The forces experienced by such winches are large. Taking the case of a sailing vessel having an overall length of 50 feet or greater, the force acting on a jib trying to unwind the jib from the stay is high. Further, the higher the wind the vessel encounters, the greater the torque on the fairing and the winch that drives the fairing.

In such devices, ratchet mechanisms which dynamically set while the sail is unwinding are unsatisfactory. Typically, such ratchets have the danger that they cannot seat against the high force and rapid angular acceleration of the fairing as the sail begins to unwind. Consequently, rapid unwinding of such roller reefing acting on ratchet mechanisms against the force of the unwinding can and does occur. When such unwinding occurs, the vessel can either go head to wind where the sail is in danger of tearing itself apart, or on the wind where the sail can become overfull and control can be lost of the boat.

Realizing the failure of such ratchet control drives. worm gear drives have been utilized. Unfortunately, such worm gear drives are required to have at least a 15 to 1 mechanical advantage. This mechanical advantage is required so that the worm gear drives can remain normally stationary.

Unfortunately, worn gear drives are notorious for their mechanical inefficiency. Ofttimes, over 50% of the energy placed in such drives is wasted in friction. Because of these inefficiencies, and where such worm gear drives are driven by hydraulic motors, the manual actuation of such drives becomes difficult if not impossible where the driving hydraulic motor fails.

Further. such worm gear drives are slow. In either taking in or letting out sail, the drives move slowly even when actuated by the hydraulic motor. Often movements occurs so slowly that the wound sail cannot accommodate changing sailing conditions.

Some manufacturers have solved the slowness of worm gear drives by providing for disengagement of the worm gear upon gathering or letting go of the sail. Unfortunately, these drives become dangerous and complex. Further, they rely upon ratchets, which ratchets can be dangerous. In short, simplicity is required at sea. Worm gear drives with disengagement mechanisms violate the rule of simplicity.

High mechanical advantage clutches are obviously known. Such high mechanical advantage clutches require a small force to engage the clutch. The clutch, once engaged, is capable of transmitting large forces. Concentric cone clutches are an example of a high mechanical advantage clutch. Such high mechanical advantage clutches have not been applied to winches related to roller reefing for the replacement of extant worm gear drives.

SUMMARY OF THE INVENTION

In a sailboat having a sail such as a Genoa jib with roller reefing for spirally winding the sail on a fairing around a stay, a winch mechanism for turning the fairing about the stay and spirally winding the sail to and from the fairing is disclosed. The winch includes a high mechanical advantage clutch, preferably a cone clutch. The cone clutch is normally engaged by load exerting an unwinding force upon the fairing through the normally engaged clutch to a normally stationary clutch driving shaft. Such closure of the clutch is preferably under action of a mating radial ramps or alternately a coarse screw acting on the second clutch member to cause engagement of the clutch. The clutch driving shaft has a first clutch member ratchetted from the vessel to permit turning of the entire clutch for taking in of the sail. The clutch includes a second clutch member attached for rotation with the fairing relative to the vessel and driven for both sail take-up and let out by the normally stationary clutch driving shaft. The normally stationary clutch driving shaft is in turn driven usually by a hydraulic motor or upon motor failure by a ratchetted winch handle.

In maintaining the sail on the fairing, the hydraulic motor is stopped and provides through the normally stationary clutch driving shaft a braking force. Responsive to this braking force, the second clutch member moves into engagement with the first clutch member and the clutch becomes engaged. With the clutch engaged, the second clutch member loads the first clutch member against its ratchet mechanism. The sail is maintained spirally wound to the nonrotating fairing and is held.

It will be realized that once the normally stationary shaft has caused the clutch to set, torque transmission through to the normally stationary shaft is no longer required to maintain clutch closure. The clutch will remain closed so long as it is not otherwise disturbed.

In taking in the sail, the normally stationary clutch driving shaft is turned to oppose the loading of the sail on the stay. Responsive to such turning, the second clutch member is urged into engagement with the first clutch member and the clutch remains firmly engaged. Sympathetic to this firm engagement and responsive to the rotation of the rotating clutch driving shaft, the first clutch member turns on its ratchet allowing the fairing to rotate only for the taking in of sail. The sail is spirally wound to the fairing and taken in.

In letting out sail, the normally stationary clutch driving shaft is turned so as not to oppose the loading of the sail on the stay. Responsive to such turning, the second clutch member moves clear of the first clutch member and the clutch becomes initially disengaged. Sympathetic to this initial disengagement, and acting under the load of the sail and the sheet, the sail spirally unwinds from the fairing. This spiral unwinding from the fairing continues until the load of the sail and the sheet causes reengagement of the first and second clutch members with reengagement of the clutch. To the extent that the normally stationary clutch driving shaft has turned, the clutch follows in its release of the sail and the sail is let out.

OTHER OBJECTS, FEATURES AND ADVANTAGES

An object of this invention is to disclose the use of a normally engaged high mechanical advantage clutch in a roller reefing winch. Accordingly, a first clutch member is ratchetted to the vessel to permit winch rotation for sail take-up. A second clutch member movable to and from a position of engagement with the first clutch member is attached to the sail fairing. Responsive to torque transmitted between the sail fairing and a normally stationary clutch driving shaft engaging the second clutch member, the second clutch member closes to the first clutch member. In such closure of the clutch, the force of the sheet and sail tending to unwind the sail on the fairing about the stay is resisted and the sail is maintained as wound to the fairing.

An advantage of the clutch is that the sail is maintained on the fairing by the clutch. Ratchet mechanisms which can fail to engage are not directly utilized against a dynamically unwinding sail.

A further advantage of the disclosed high mechanical advantage clutch is that a direct positive drive through the clutch for winding of the sail is disclosed. Simply stated, by turning the normally stationary clutch driving shaft so that gathering of the sail occurs, a direct and positive drive of the winch to wind the sail fairing is provided. Ratchetting of the clutch through the first ratchetted clutch member is slow, positive, and not dynamically active against the high speed unwinding force of the sail on the fairing.

A further advantage is that by driving the normally stationary meshed clutch driving shaft in an opposite direction for unwinding of the sail, the clutch is partially disengaged. This partial disengagement continues until the force on the sail and sheet combines to reseat the clutch. Consequently, the clutch disengages and permits unwinding of sail only to the extent that the normally stationery shaft is driven to permit such unwinding.

An advantage of this aspect of the invention is that unwinding forces acting on the sail are resisted by closure of the clutch. The setting of ratchets against the dynamic forces of said unwinding is not required.

A further object to this invention is to disclose the use of a cone clutch. Specifically, the cone clutch is mounted concentrically about the stay and directly connected to the fairing.

An advantage of such a cone clutch is its extreme simplicity. Cone clutches are high mechanical advantage clutches that because of their simplicity can withstand the harsh marine environment to which such roller reefing winches are subjected.

A further object to this invention is to disclose a mechanically simple device for maintaining a cone clutch normally engaged.

According to a first embodiment. confronted plates are utilized. These plates have radial ramps configured on their confronting edges. By allowing the ramps to move relative to one another in high mechanical advantage, the clutch is normally maintained closed. Alternatively, by moving the radial ramps in an opposite direction, disengagement of the clutch occurs.

According to an alternate embodiment of this invention, coarse screw threads can be utilized for clutch engagement and disengagement.

An advantage of the clutch mechanisms is that the forces tending to close the clutch are directly responsive to the torque exerted on the winch. The clutch is modulated in its engagement by the forces of sail unwinding which the engaged clutch opposes.

A further object to this invention is to disclose a simplified drive. Specifically, a normally stationary clutch driving shaft is provided with two inputs of power. A motor from below deck is utilized to drive the shaft. this motor typically being hydraulic or electric. Alternately, and upon motor failure, a ratchetted winch handle can be utilized for driving the shaft from above. An advantage of this aspect of the invention is that the emergency drive of the disclosed winch is vastly simplified.

BRIEF DESCRIPTION OF THE DRAWINGS

Other objects, features and advantages of this invention will be more apparent after referring to the following specification and attached drawings in which:

FIG. 3 is a side elevation section similar to FIG. 2A illustrating an alternate course screw engagement mechanism for the clutch.

Referring to FIG. 1, a vessel V is shown having a deck mounted winch W. Winch W is concentrically mounted to a stay S and winds and unwinds a Genoa jib J to and from a fairing F mounted for concentric rotation on the stay. Fairing F mounts to a swivel 12 at the top of the stay S on mast M. Jib J is threaded to a recess in fairing F.

Sail S is tensioned at its clew to sheet 14. Sheet 14 leads to a winch 20 mounted on the deck D of the sailboat. Specifically, as sheet 14 is brought in. additional torque is exerted on fairing F.

Those familiar with sailing will immediately understand that as wind loads increase, loading on sheet 14 and jib J likewise increases. Consequently, the forces on fairing F tending to unwind jib J likewise increase. As the winch of this invention is utilized on boats exceeding 50 feet in length, great unwinding forces in the range of 600 foot pounds of torque can be encountered.

Figure 2A:
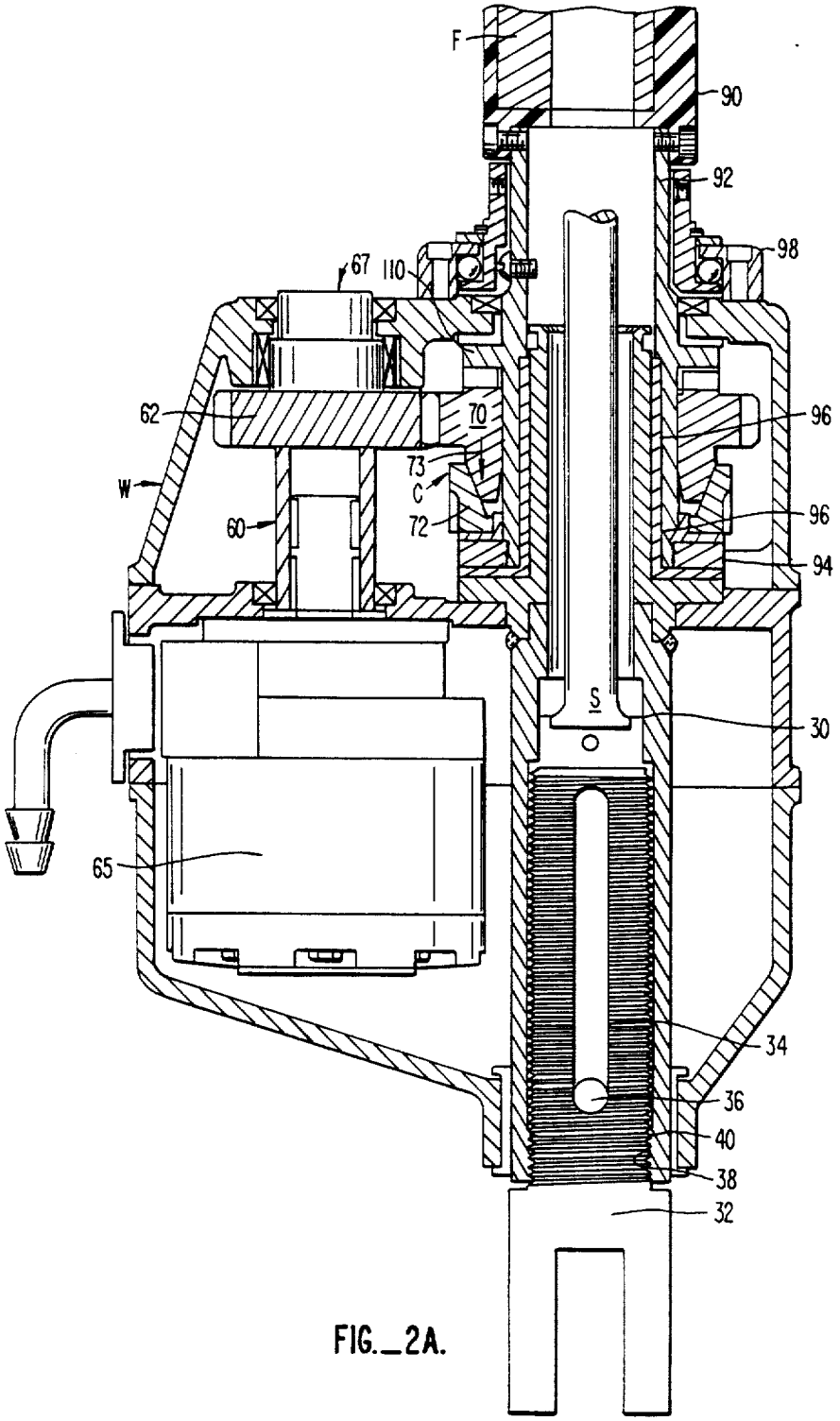
FIG. 2 is a side elevation section of the winch mechanism of this invention. this side elevation section illustrating the cone clutch of this invention.
FIG. 2B is a plan view of the winch of FIG. 2A illustrating the lead of the sail relative to the wind, the winding direction for taking in the sail and the disposition of the bow of the vessel.
FIG. 2C is a schematic of paired members for engaging the cone clutch, the paired members including radial ramps for providing high leveraged engagement of the clutch.
FIG. 2D is a section of the fairing connected to the winch mechanism.
FIG. 2E is an exploded view of the radial ramps for urging the clutch to the normally closed position.

Referring to FIG. 2A, the winch mechanism of this invention is shown in side elevation section. Specifically, a stay S is illustrated having a swedged fitting to a swedged support 30. Swedged support 30 defines at the lower end thereof threads 38. Threads 38 engage threading 40 on a stay attachment 32.

Stay attachment 32 defines a slot 34 crossed by a pin 6 from support fitting 30. As is common in the prior art, up and down adjustment of stay S can occur.

Figure 2B:
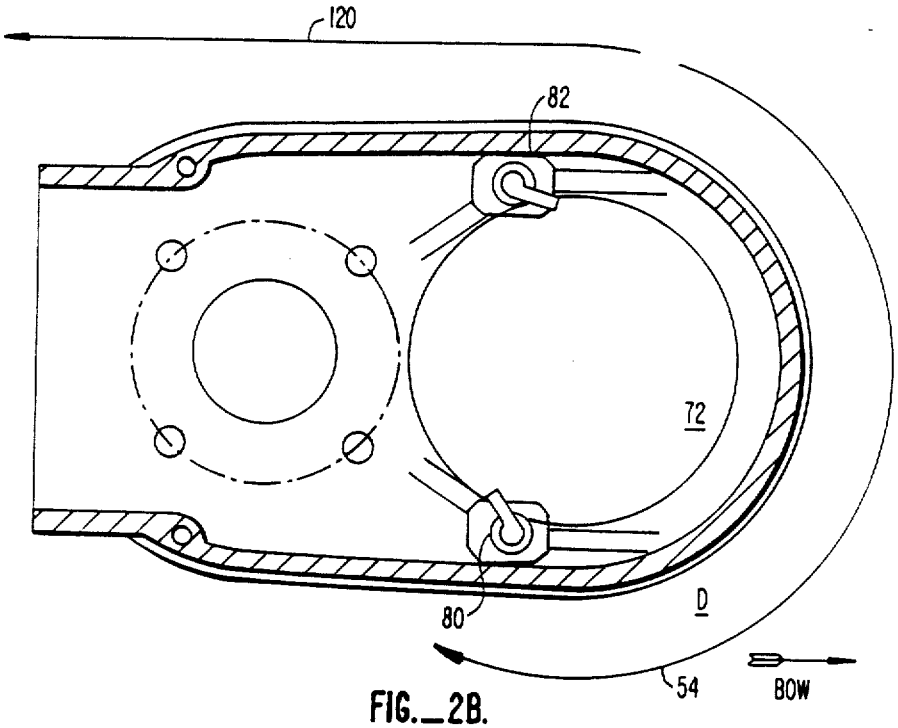

Winch W fits around the stay. Winch W attaches at its upper end to a fairing F (see both FIG. 2A and FIG. 2D). Fairing F includes a threaded luff line 50 fitting within a luff line cavity 52 on the fairing. Jib J leads aft from the fairing. It can be seem from the illustration in FIG. 2 that the fairing is spirally wound with jib J in the direction of the arrow 54.

Figure 1:
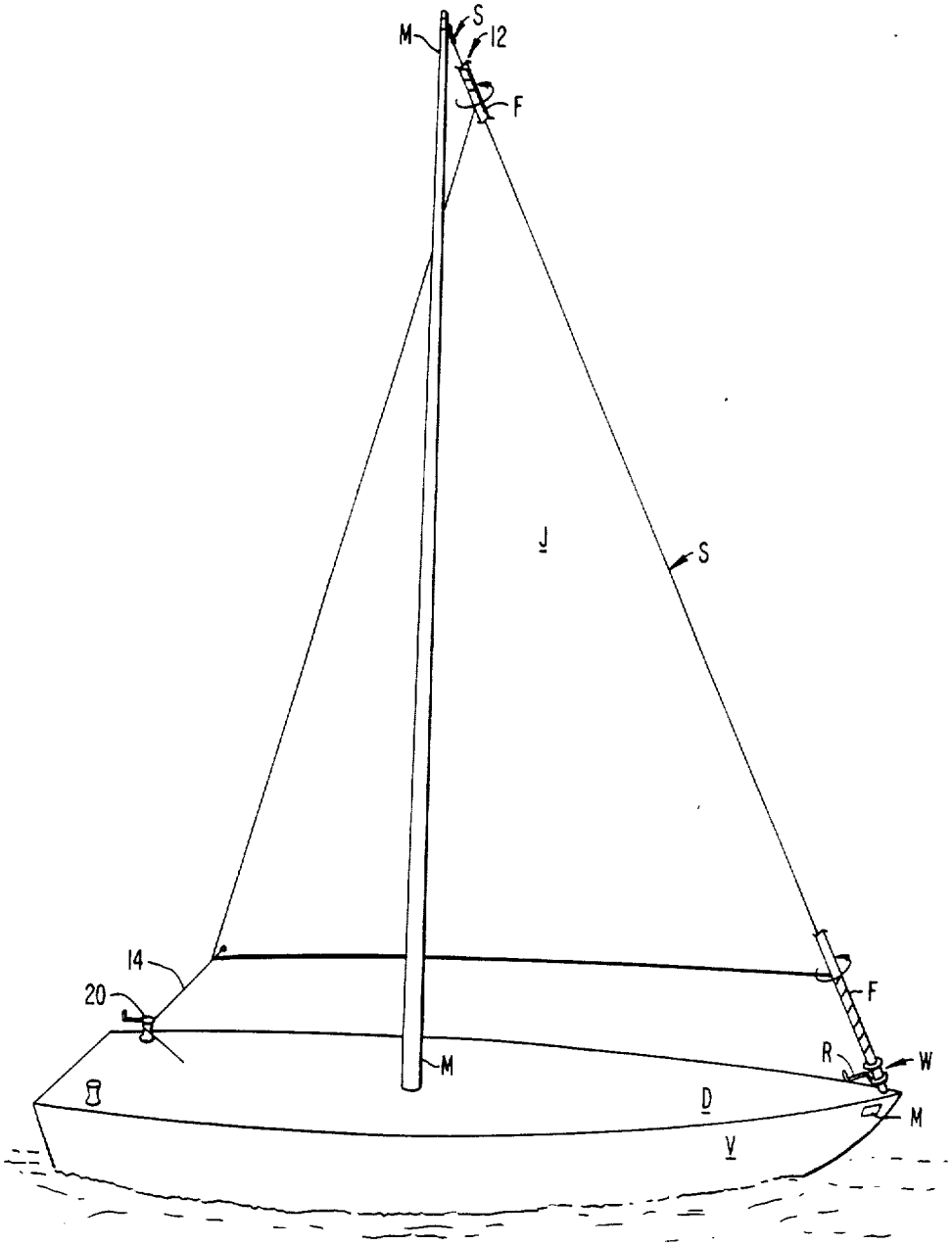
FIG. 1 is a schematic of a vessel having a winch attached to the forestay for rotating a fairing around the forestay to take in and let out a spirally wound sail.

Having set forth the construction of the stay S and the relative rotation of the fairing F, attention will now be directed to the winch components. A normally stationery shaft 60 is provided with a gear 62. Shaft 60 is driven by a motor 65. Alternately. and upon failure of the motor 65, a ratchetted winch handle R (see FIG. 1) can engage end 67 of the shaft.

The high mechanical advantage cone clutch C includes two clutch members. These clutch members include a male member 70 and a female member 72. Male member 70 is configured with a lower conical surface. Likewise, female member 72 has a complementary conical surface. By the engagement of male clutch member 70 in the direction of arrow 3, the clutch becomes engaged. Lower clutch member 72 is ratchetted for rotation to the deck D of vessel V (see FIG. B). Ratchets 80, 82 engage lower clutch member 72. The ratchets are disposed to permit rotation of the clutch in the direction 54. Such rotation permits jib J to be wound about fairing F as illustrated with respect to FIG. 2D.

The reader will understand that the prior art section of this patent application has been critical of ratchet mechanisms such as ratchets 80, 82. However, it will be realized that these ratchets are only active when the sail is being taken in. The ratchets move relative to the clutch member 72 at low speed. These ratchet members 80, 82 do not have to act rapidly against a rapidly accelerating clutch member 72. Indeed it is the purpose of this invention never to subject the lower clutch member 72 to rapid angular acceleration under the full force and torque exerted on the fairing F by a sail being let out.

Referring further to FIG. 2A. fairing F attaches to a coupling 90. Coupling 90 rotates with and is fixed to rotating shaft member 92. Shaft member 92 is fastened to a nut 94, which nut transmits any thrust from clutch member 72 to rotating shaft member 92. The member 92 rotates on a bearing 96. As is conventional. an outer race tack swivel permits fastening of the sail tack.

Having set forth the general constructions, the operation of the clutch in male member 70 engaging female member 72 in the direction of engagement 73 can now be set forth. This is best seen with respect to FIG. 2C.

Figure 2C:
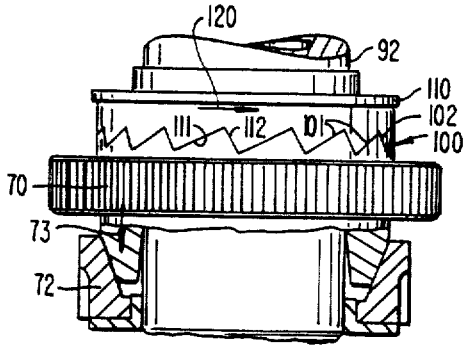
Figure 2D:
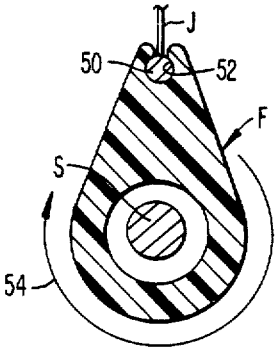

Referring to FIG. 2C. male clutch member 70 is shown having its top surface 100 configured with radial ramps. The radial ramps include a gradually inclined ramp 101 and a steeply inclined radial ramp 102.

Likewise. an annular member 110 protruding outwardly from rotating member 92 likewise includes radial ramps. These radial ramps include a mating gradually sloping radial ramp 11 and a mating steeply sloping radial ramp 112.

The action of these radial ramps can readily be understood.

Referring briefly to FIG. 2B, it can be seen that the sail leads along a line 120. Remembering that the jib J and the sheet 14 exert a substantial force, it will be seen that the annular flange 110 is urged in the direction of rotational arrow 120 under transmitted torque from fairing F. Such urging causes the gradually sloped radial ramps 111 and 101 into firm contact one with another. This contact causes male clutch member 70 to move in the direction of vector 73 into female clutch member 72. Engagement occurs.

It will be remembered that this movement occurs because normally stationary shaft 60 engages with gear 62 the periphery of male clutch member 70. Thus under the torque supplied by the fairing F to the member 82, the opposed radial ramps 101, 111 cause a downward thrust on the clutch.

Take-up of the clutch member is likewise easily understood. Specifically normally stationary shaft 60 rotates in the direction of vector 120. Such rotation maintains the firm engagement between the radial ramps 101, 111. Upper clutch member 70 rotates. Likewise, lower engaged clutch member 72 again rotates.

Lower clutch member 72, however, rotates so that ratchets 80, 82 permit slow take-up rotation. As is conventional. the ratchets are angularly sized with respect to ratchet grooves so that one or the other ratchets is positioned for engagement. It has been emphasized that the take-up rotation is slow. There therefore is no danger that ratchets 80 or 82 cannot act to see their respective stops on the periphery of the lower clutch member 72.

Let out of the sail is more difficult to understand but with the background previously set forth can now be more easily stated. Specifically, normally stationary shaft 60 rotates in a direction to turn upper clutch member 70 in the direction of sail let out. Responsive to such turning, initial disengagement of the gradually inclined confronting radial ramps 101, 111 occurs. This causes forces of engagement between the male clutch member 70 and the female clutch member 72 to relax. This relaxing force, however, is immediately taken up by the stress on the jib J and the sheet 14.

This take-up stress in the direction of vector 120 immediately resets the clutch. This resetting of the clutch members 70, 72 occurs only after release of sail correspondent to the rotation of shaft 60 and the gear 62 has occurred. Thus insofar as release occurs by rotation of shaft 60 correspond release of the jib J will occur. The minute, however, that the male clutch member 70 releases correspondent to the rotation provided by the normally stationary shaft 60 and gear 62, torque is immediately applied from the sail.

It will be therefore understood that the forces of engagement in letting out of the jib J are not dependent upon the action of the ratchets 80, 82. It will be remembered that these ratchets are firmly engaged and not in action during sail release. Rather, the action of the high leverage male clutch member 70 with respect to the female clutch member 72 effects the desired braking of the sail from unwinding about the fairing.

The reader will realize I prefer a cone clutch. Other clutches having high mechanical advantage may as well be used. For example, a multidisc clutch could be used.

Regarding. the normal closure of the cone clutch, I prefer the action of the radial ramps. Coarse screw threads can be utilized as well. Referring to FIG. 3A such an embodiment is illustrated.

Referring to FIG. 3A. a male clutch member 70 and a female clutch member 72 are illustrated. Rotating member 92 is also shown.

Over the prior embodiment. member 92. includes inner, concentric coarse threads 151. Male clutch member includes mating coarse threads 152. The course threads acting under torque from the fairing F (not shown) cause engagement of the clutch members along the direction of vector 73. Operation of the winch mechanism occurs as before.

It will thus be realized that the illustrated high leveraged clutch concentrically mounted for rotation about the stay provides a superior winch retaining apparatus. This superiority is a direct result of the use of a high leverage clutch to effect engagement during sail letting out so that virtually no possibility of inadvertent release of the furled jib J about the fairing F can occur.

I show rotation of the clutch from a normally stationary shaft through gear drives. Other drives can be used as well. For example, certain belts, chain and sprocket drives. as well as other expedients can be substituted.

I claim:

1. A winch for rotating a fairing about a stay on a sailing vessel, the fairing having a sail attached thereto for roller reefing of the sail in a spiral wind about the fairing, the winch comprising:

a normally stationary shaft having a shaft for driving a clutch;

a high mechanical advantage clutch member having a first clutch member and a second clutch member relatively movable with respect to each other between positions of normal engagement and a position of disengagement;

said first clutch member mounted for one way rotation relative to the vessel in a first direction to permit said sail to be gathered to said fairing for the reefing of said sail;

said second clutch member having a peripheral portion driven from said normally stationary shaft said second clutch member attached to said fairing for rotation with said fairing for reefing in and reefing out said sail;

a clutch engagement member positioned between said normally stationary shaft and said fairing, said clutch engagement member urging said clutch into said normally engaged position responsive to torque transmitted between said normally stationary shaft and said fairing; and, driving means attached to said normally stationary shaft for maintaining said shaft stationary during nondriving operation, rotating said first and second clutch members in a first direction for engaging said clutch and taking in said sail, and rotating said second clutch member in a second and opposite direction for temporarily disengaging said clutch to permit release of said sail corresponding to the rotation of said normally stationary shaft.

2. The invention of claim 1 and wherein said clutch engagement member acting responsive to torque between said normally stationary shaft and said fairing includes opposed radial ramps, one said radial ramp rotating with respect to said fairing and acting on said second clutch member said second radial ramp configured in said second clutch member, said radial ramps adapted for engagement of said clutch member responsive to torque transmitted from said fairing to said normally stationary shaft.

3. The invention of claim 1 and where said clutch engagement member includes mating first and second coarse screw threads said first mating screw threads being configured to rotate responsive to torque transmitted from said fairing to said normally stationary shaft;

said second mating screw threads being configured in said second clutch member whereby engagement of said clutch normally occurs.

4. The invention of claim 1 and wherein said normally stationary shaft is driven by a hydraulic motor.

5. The invention of claim 1 and wherein said normally stationary shaft is driven by a ratchetted winch handle.

6. The invention of claim 1 and wherein said normally stationary shaft drives said second clutch member through mating gears.

* * * * *